United States Patent [19]

Crabtree

[11] 4,336,576

[45] Jun. 22, 1982

[54] LIGHTING APPARATUS

[76] Inventor: Daniel B. Crabtree, 10426 Moorberry, Houston, Tex. 77043

[21] Appl. No.: 138,215

[22] Filed: Apr. 7, 1980

[51] Int. Cl.[3] ..... F21V 7/02

[52] U.S. Cl. ..... 362/240; 362/247; 362/296; 362/297; 362/346; 362/349; 362/350; 362/241

[58] Field of Search ..... 362/227, 240, 241, 247, 362/291, 292, 323, 346, 349, 350, 296, 297

[56] References Cited

U.S. PATENT DOCUMENTS

| | | | |
|---|---|---|---|
| 2,892,076 | 6/1959 | Moos | 362/247 |
| 3,829,677 | 8/1974 | De Llano | 362/346 |
| 4,218,727 | 8/1980 | Shemitz et al. | 362/346 |

FOREIGN PATENT DOCUMENTS

| | | | |
|---|---|---|---|
| 2299689 | 1/1975 | France | 362/349 |
| 563352 | 8/1944 | United Kingdom | 362/247 |

*Primary Examiner*—Irwin Gluck
*Attorney, Agent, or Firm*—Carl B. Fox, Jr.

[57] ABSTRACT

Lighting apparatus having less than the conventional number of light sources, but which provides illumination substantially equivalent to the illumination provided by the conventional apparatus, thereby providing savings in energy consumption and in cost of operation. Part of the light output of the light sources which are provided is reflected to illuminate areas of the diffuser plate which are illuminated by additional light sources in conventional apparatus, whereby it appears that a full number of light sources are provided when in fact less than a full number of light sources are provided.

26 Claims, 9 Drawing Figures

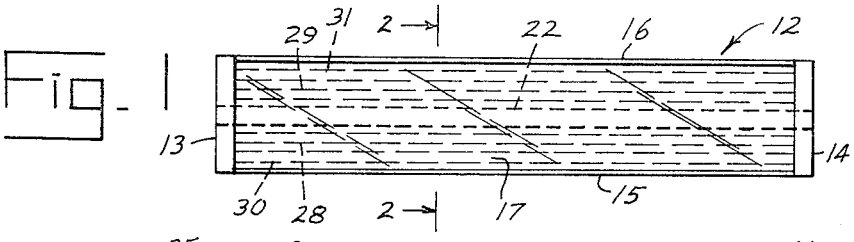
Fig. 1
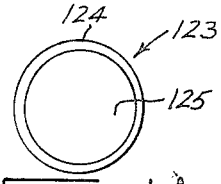
Fig. 1A
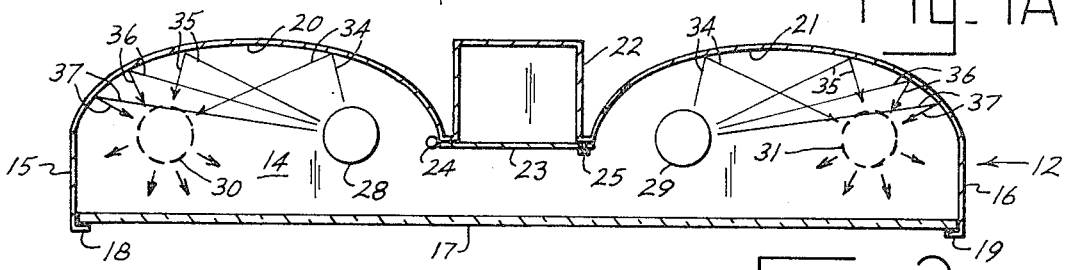
Fig. 2
Fig. 3
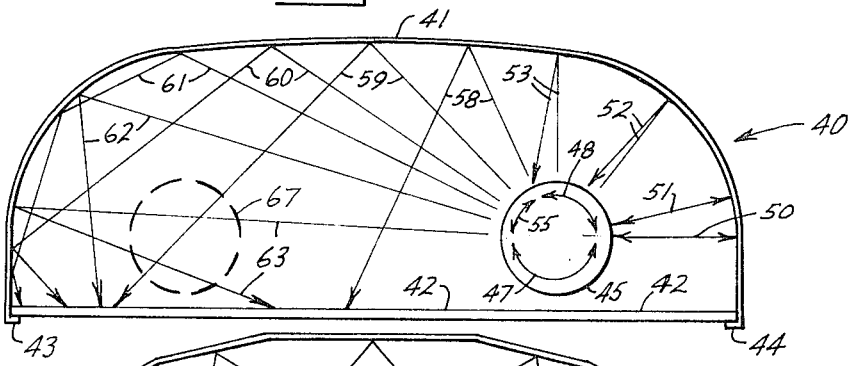
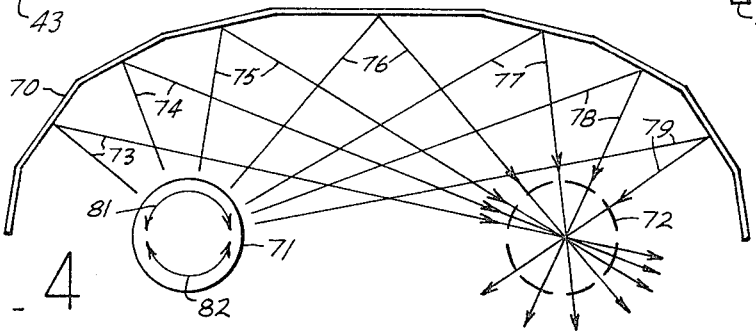
Fig. 4
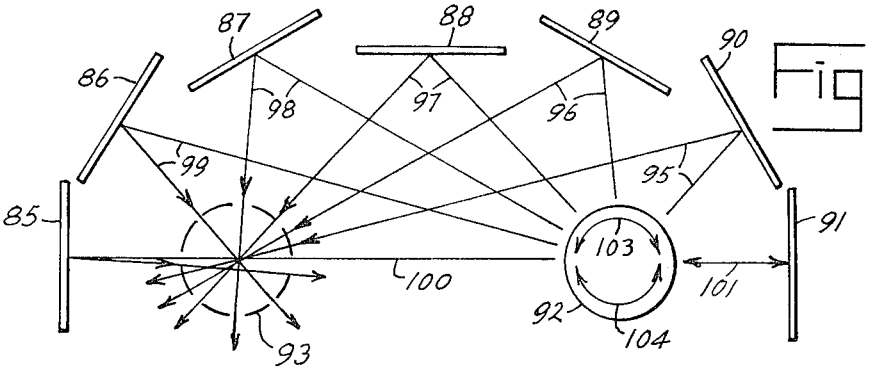
Fig. 5

LIGHTING APPARATUS

BACKGROUND OF THE INVENTION

In apparatuses having plural light sources, e.g. fluorescent lamps or incandescent filament lamps, the light sources are usually deployed to illuminate a diffuser as evenly as possible. In view of the present energy shortage, it would be economical with regard to both energy saving and economy if one or more of the light sources in such apparatuses could be eliminated. Lighting fixtures of the types under consideration usually have from two to five or six light sources. If approximately one-half of the light sources could be eliminated, with less than proportionate reduction in light output, considerable savings could be realized. The present invention seeks to provide lighting apparatus or fixtures using less than the conventional number of light sources, yet providing illumination approximating that of conventional lighting apparatus having a full number of light sources. The apparatuses according to the invention may be provided as new equipment or as modifications of existing equipment.

SUMMARY OF THE INVENTION

According to the invention, lighting equipment is provided which utilizes as nearly as possible the full light output of the light sources. In conventional equipment, a large part of the light output is wasted or poorly directed as a result of uneconomical design, since heretofore economy of light usage and cost was not in many cases a prime consideration. According to the invention, lighting fixtures or apparatuses are provided wherein some of the light sources are eliminated, the remaining light sources which are provided being disposed so that light output from all sides thereof is more fully utilized, thereby eliminating waste of light output. The light fixtures provided may be full size as compared with conventional fixtures.

As an example of lighting apparatus which may be provided according to the invention, a light fixture may be provided having, for example, one light source where two were previously provided, or two light sources where four were heretofore provided. The light source or sources which are provided are disposed at the same or similar locations at which light sources were provided in conventional equipment, with the location or locations of one or more others of the light sources being unoccupied or empty. Light from a portion of the light emitting surface area of each light source is directed toward the location where in conventional equipment there would be another light source, but where in equipment according to this invention there is no light source.

For example, in some conventional equipment two fluorescent tubes are provided, parallely disposed, along an area above which there is disposed a reflective surface. According to conventional equipment, two light sources each illuminate one half of the reflective surface and a diffuser plate disposed below the fluorescent tubes. According to the invention, one of the fluorescent tubes is omitted, the other being in its conventional location, but the reflector is designed such that light from the upper half of the tube which is present is reflected to the location of the tube which is not present. In this way, from below the diffuser plate, it appears as though two fluorescent tubes are present, in spite of there being only one present. According to the invention, part of the light may be reflected from one tube to a location in which no tube is present, to illuminate approximately one-half of the area of the diffuser plate.

Two types of reflective surfaces may be employed. One type is a reflective surface of the mirrored surface type, wherein an actual image of the fluorescent tube or other light source is reflected to the required location. In the other type of the reflective surface, the light is reflected without reflection of an image.

A principal object of the invention is to provide lighting apparatus which maximizes the useful light output of a light source or sources. Another principal object of the invention is to provide light apparatus and fixtures wherein one or more light sources of conventional apparatus are eliminated. A further object of the invention is to provide such apparatus in which approximately one-half of the light output of the light source is reflected to another location, particularly to another location where a light source has been eliminated from the apparatus. Another object of the invention is to provide such apparatuses wherein fluorescent tubes are used as light sources, and wherein incandescent light bulbs are used as light sources. A further object of the invention is to provide such apparatus having dimensions equal or similar to the dimensions of conventional apparatuses, whereby conventional apparatuses may be replaced by apparatuses according to the invention. Yet another object of the invention is to provide such apparatuses which are dependable, economical, energy saving, and of high utility.

Other objects and advantages of the invention will appear from the following detailed descriptions of preferred embodiments thereof, reference being made to the accompanying drawings.

BRIEF DESCRIPTIONS OF THE DRAWINGS

FIG. 1 is a schematic lower elevation illustrating a principal type of apparatus with which the invention is concerned.

FIG. 1A is a schematic lower elevation showing a circular lighting apparatus.

FIG. 2 is a schematic vertical cross section of the apparatus shown in FIG. 1, taken at line 2—2 of FIG. 1.

FIG. 3 is a schematic illustration of a form of apparatus not satisfactorily conforming with the invention.

FIG. 4 is a schematic representation illustrating a modified form of apparatus according to the invention.

FIG. 5 is a schematic drawing illustrating another modified form of apparatus according to the invention.

DESCRIPTIONS OF THE PREFERRED EMBODIMENTS

Figure 6:
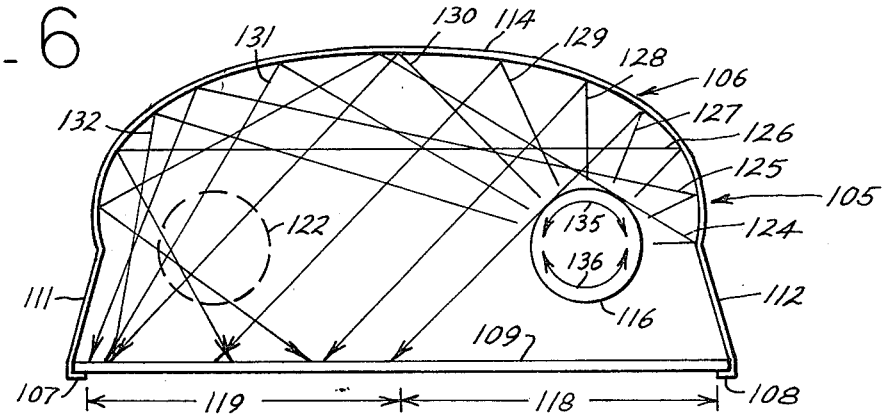
FIG. 6 is a schematic representation illustrating yet another form of apparatus according to the invention.

Referring now to the drawings in detail, and first to FIG. 1, there is shown a lighting fixture 12 of generally conventional form, modified according to the invention. Fixture 12 has end members 13, 14 and side walls 15, 16 surrounding a diffusion plate 17 supported therewithin. Referring also to FIG. 2, the diffusion plate 17 is supported by flange formations 18, 19 inturned from the lower edges of walls 15, 16, respectively. Walls 15, 16 arch upwardly at 20, 21 respectively, to form the top of the apparatus, and have connection with opposite sides of rectilinear housing 22 which extends the full length of the apparatus. The lower side 23 of housing 22 is hinged at 24 and latched at 25, so that side 23 may be swung downwardly when diffuser plate 17 is removed in order to provide access to its interior. Housing 22 will contain the necessary wiring and ballast and electrical connections for operation of the apparatus, these elements not being shown but being well known in the art.

It will be realized that the showings of both FIG. 1 and FIG. 2 are schematic, and do not show all structural details of the apparatus, such details being readily provided by a person skilled in the art. The apparatus will also include means for supporting the apparatus in its desired location of use, which may take any suitable form. The apparatus may be supported suspended from a ceiling or may be supported within an aperture through a ceiling or wall.

The apparatus includes two fluorescent lighting tubes 28, 29. In conventional apparatus, two additional tubes would be provided at dashed lines locations 30, 31. However, the tubes which would conventionally be provided at locations 30, 31 are omitted, and light is supplied to their locations from the tubes 28, 29. As is indicated by arrows 34–37 at each side of FIG. 2, the curvatures of walls 15, 16 at their reflective portions 20, 21, respectively, are such that light from sources 28, 29 is reflected to locations 30, 31. In this way, although there are no fluorescent tubes at locations 30, 31, from beneath diffuser plate 17 it is made to appear, at least to some extent, that tubes are present at those locations. Light from the lower halves of fluorescent tubes 28, 29 shines directly upon the upper surfaces of plate 17 longitudinally below tubes 28, 29.

According to the invention, in an ideal apparatus according thereto, the light from the upper halves of tubes 28, 29 is reflected to locations 30, 31. In conventional apparatus, the light from the upper sides of the tubes 28, 29 is not effectively reflected to the diffuser plate areas beneath locations 30, 31, and those areas are relatively dark. If the precepts of the invention are followed religiously, the areas of plate 17 beneath locations 30, 31 may be made almost as bright as the areas of plate 17 beneath the tubes 28, 29. Some light is always lost through reflective losses, so that the areas beneath locations 30, 31 will be somewhat less illuminated than the areas beneath tubes 28, 29, but a close approximation to equal illumination may be obtained provided the lower sides of wall portions 20, 21 are sufficiently reflective. The apparatus shown in FIG. 2 is not the best apparatus which may be provided according to the invention, but to a large degree this apparatus adheres to the principles of the invention.

Referring now to FIG. 3 of the drawings, there is shown an apparatus 40 which is of poor design according to the invention, presented in order to illustrate design features which should not be included in a preferred form of apparatus. Apparatus 40 includes curved reflector plate 41, diffuser plate 42 supported by inturned flanges 43, 44 along opposite sides of plate 41, and light source 45. Light source 45 may be a fluorescent tube or another form of light source such as an incandescent light bulb. Light from arcuate portion 47 of source 45 shines directly onto diffuser plate 42. Light from arcuate portion 48 of tube 45 is reflected back to the tube as indicated by arrows 50–53. Only the light from arcuate portion 55 of tube 45 is reflected to the opposite side of diffuser plate 42, as indicated by arrows 58–63. The reflected light is not concentrated at a phantom tube location 67, as is the case in FIG. 2. The degree of illumination of diffuser plate 42 at its righthand portion will be much greater than the degree of illumination at its lefthand portion, and therefore the result is not in conformity with the results obtainable according to the invention.

Referring now to FIG. 4 of the drawings, there is shown a segmentally angular reflector plate 70 beneath the lefthand portion of which is disposed a light source 71. The location 72 indicates where a second light source can be located in a conventional apparatus designed for balanced illumination of a diffuser plate disposed beneath the two light source locations, a light source not being provided at location 72 in the showing of FIG. 4. The reflector 70 is symmetrical with regard to a vertical plane midway between tube 71 and location 72. Each angular portion or segment of the reflector 70 is at a pitch to reflect light from source 71 to location 72, as indicated by the arrows 73–79. An apparatus of this design closely follows the principals of this invention by reflecting most of the light from the upper portion 81 of tube 71 to location 72. Light from lower portion 82 of light source 71 will light the lefthand portion of a diffuser plate, while light from upper portion 81 will illuminate the righthand portion of a diffuser plate.

The design indicated schematically in FIG. 5 indicates that separate strips 85–91 may be disposed to reflect light from a source 92 to a symmetrical location 93, the paths of reflected light being indicated by arrows 95–100. Light following path 101 will be reflected back to tube 92, and will not reach the opposite side of the apparatus. However, a substantial portion of the light from source 92, indicated by arc 103, will be reflected to the vicinity of location 93. The light from the lower portion 104 of tube 92 will illuminate the righthand portion of the diffuser plate placed beneath the apparatus shown, while the reflected light from the upper portion of the light source 92 will illuminate the lefthand portion of the diffuser plate.

The apparatus 105 shown in FIG. 6 of the drawings includes an upper element 106 the inner side of which has a light reflective surface, and which has inturned flanges 107, 108 along its opposite sides to support translucent diffuser plate 109. Element 106 is elongate, in the form of one side portion of the apparatus shown in FIGS. 1 and 2. Element 106 has angular side portions 111, 112 adjacent flanges 107, 108, respectively, and has curved portion 114 upwardly arched therebetween. Diffuser plate 109 is of rectilinear shape, square or rectangular, and its opposite sides are disposed upon flanges 107, 108. A light source 116 is disposed above diffuser 109 above one longitudinal half portion 118 thereof. The opposite longitudinal half portion 119 of diffuser plate 109 is below dashed line location 112, which is where another light source would normally be disposed in a conventional lighting fixture. However, no such light source is provided in the apparatus shown in FIG. 6.

Arrows 124–132 indicate the direct and reflected directions of light emanating from source 116. It will be noted that approximately the upper half portion of light source 116, indicated by arrow 135, has its light output reflected to portion 119 of diffuser plate 109. Light from the lower approximate half portion 136 of source 116, of course, shines directly mostly against portion 118 of diffuser plate 109. Therefore, the apparatus of FIG. 6, which is a preferred form of apparatus, closely follows the principle of the invention that about half of the light from the source should fall on a diffuser plate area adjacent the light source, and that the other half of the light should fall on a diffuser plate area remote from the light source, where no other light source is provided, in order that both half portions of the diffuser plate shall be substantially equally illuminated.

While apparatus 105 is illustrated to be a fluorescent lighting fixture, with source 116 being a fluorescent tube or bulb, it should be recognized that the same principles may be applied to a lighting fixture having one or more incandescent light bulbs as light sources. For example, if fluorescent tube 116 were replaced with a series of incandescent light bulbs aligned along the path of tube 116, then the light from the upper sides thereof would be reflected to portion 119 of diffuser plate 109, while portion 118 of diffuser plate 109 would receive light directly from the lower sides of the series of incandescent light bulbs. As another alternative, if element 106 is of circular domed shape, portions 111, 112 being a surrounding conical beveled skirt formation, and flanges 107, 108 being a continuous circular flange, then a light source such as incandescent light bulb at location 116 at one side of element 106 would reflect light from its upper side to the opposite side of element 106 at a diametrically opposite location 122 from the light bulb, with a result similar to that achieved where a fluorescent light source of tubular form is utilized. A lower view of such a circular apparatus 123 is shown in FIG. 1A, having skirt formation 124 and diffuser 125.

Figure 7:
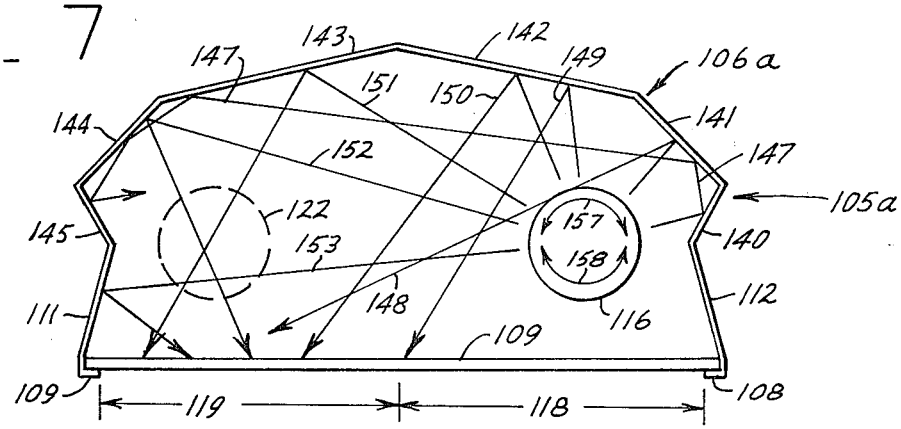
FIG. 7 is a schematic representation illustrating a further form of apparatus according to the invention.

FIG. 7 shows an apparatus similar to that shown in FIG. 6. Similar parts are designated by the same reference numerals as are used in FIG. 6. The apparatus 105*a* is modified with respect to the apparatus 105 of FIG. 6, in that element 106*a*, corresponding to element 106 of FIG. 6, is formed by segmental angular elongate flat strip formations 140–145, instead of having a continuous arched curvature. Arrows 147–153 indicate the direct and reflected light paths from the upper portion 157 of source 116. Light from lower portion 158 of source 116 shines directly against side portion 118 of diffuser plate 109, while light from portion 157 of light source 116 is reflected mainly to opposite side portion 119 of diffuser plate 109.

As in the case of apparatus of FIG. 6, the apparatus of FIG. 7 may have either a single elongate fluorescent tube as its light source, or may have as a light source one or more incandescent light bulbs. The element 106*a* may be elongate as in FIG. 1 of the drawings, or may be circular as in FIG. 1A of the drawings.

Figure 8:
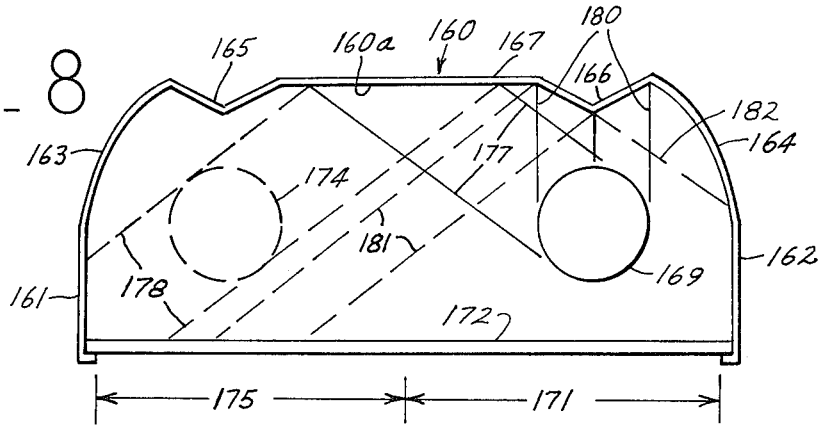
FIG. 8 is a schematic representation illustrating yet another form of apparatus according to the invention.

FIG. 8 shows another form of apparatus according to the invention. The reflector cover 160 has vertical flat portions 161, 162, inwardly curved portions 163, 164, downwardly disposed angular portions 165, 166 and flat horizontally disposed portion 167. A light source 169 is disposed above one longitudinal side portion 171 of translucent diffuser 172. Location 174 above longitudinal half portion 175 of diffuser plate 172 is where a second light source would be located symmetrically with source 169 in a conventional apparatus. Source 169 is located directly below angular formation 166, and location 174 is located directly below angular formation 165. Source 169, of course, will be supported in conventional manner at its ends, and a suitable ballast, and suitable wiring and connections from an electrical power source will be provided for energization of the light source. Since these elements are conventional, they are not shown in the drawing.

Light emanating from source 169 is illustrated in a different manner in FIG. 8 than has been used in the other drawings. In FIG. 8, interior surface 160*a* is a mirrored reflective surface capable of reflecting images of source 169. In other words, if one were to look at surface 160 from a direction and angle properly disposed, one would see an image of source 169 of the type seen by reflection of a mirror. Solid lines 177 indicate a direct image path from source 169 and dashed lines 178 indicate the reflected image. Lines 180 indicate another direct image path from the source to the reflector. In this case, the image is divided into two reflected paths 181, 182, shown by dashed lines, because of the oppositely angled portions at the opposite sides of reflector portion 166. This type of angular formation prevents reflection of light from the source back to the source, and may be employed to improve light saving not only in the FIG. 8 form of apparatus according to the invention, but in other forms of the apparatus as well.

The various forms of apparatus employing the principles of the invention all serve to improve lighting efficiency and to improve energy economy. Lighting equipment may be provided according to the invention which is suitable to replace conventional equipment, yet which will use about one-half the energy required for conventional equipment without substantial reduction in lighting output. Conventional equipment may be modified by elimination of one or more light sources, if reflective surfaces are provided therein to provide light at the diffuser areas originally lighted by the eliminated light source or sources. In all apparatuses according to the invention, highly reflective reflector surfaces should be provided, either mirrored or otherwise having minimum light absorption, in order that the highest efficiency may be achieved. Circular fluorescent tubes may be used as light sources.

While preferred embodiments of apparatus according to the invention have been described and shown in the drawings, many modifications thereof may be made by a person skilled in the art without departing from the spirit of the invention, and it is intended to protect by Letters Patent all forms of the invention falling within the scope of the following claims.

I claim:

1. In lighting apparatus of the type having plural light sources disposed between diffuser plate means and reflector means wherein conventionally at least two of the light sources are disposed in each of at least one chamber formed between diffuser plate means and reflector means, the improvement comprising eliminating at least one light source from each said chamber without altering the positions of remaining light sources, and providing reflector means adapted to reflect light from the side of each remaining light source away from said diffuser plate means onto areas of said diffuser plate means away from the remaining light source means, whereby the portions of said diffuser plate means adjacent said light source means are primarily illuminated by direct light from said light source means and portions of said diffuser plate means away from said light source means are primarily illuminated by reflected light from said light source means.

2. The combination of claim 1, said apparatus including one said chamber and one said light source therein.

3. The combination of claim 1, said apparatus including two said chambers and having one said light source in each chamber.

4. The combination of claim 1, said reflector means comprising reflective surface means capable of reflecting light from said side of each remaining light source away from said diffuser plate means to the location of an eliminated light source.

5. The combination of claim 1, said reflector means comprising reflective surface means capable of reflecting an image of each said side of each remaining light source away from said diffuser plate means to the location of an eliminated light source.

6. The combination of claim 1, 2, 3, 4, or 5, said reflector means comprising concavely curved reflective surface means.

7. The combination of claim 1, 2, 3, 4, or 5, said reflector means comprising parallel concavely angularly disposed flat reflective segments of continuous reflector body means.

8. The combination of claim 1, 2, 3, 4, or 5, said reflector means comprising plural separate reflective strips disposed spacedly parallel in a concave formation.

9. The combination of claim 1 wherein said reflector means each has a mirrored reflective surface of high reflective efficiency.

10. The combination of claim 1 wherein said reflector means each has a diffusing reflective surface of high reflective efficiency.

11. Lighting apparatus, comprising at least one reflector means, at least one light source means, and at least one diffuser plate means, at least one of said light source means being supported spacedly adjacent at least one first portion of each of said diffuser plate means, each said diffuser plate means having at least one second portion extending from each said first portion laterally spaced from a said light source means, a said reflector means extending spacedly over each said diffuser plate means with at least one of said light source means spacedly between each said diffuser plate first portion and said reflector means, each said reflector means being adapted to reflect a substantial portion of the light from one side of each said light source means spacedly adjacent thereto toward each said second portion of said diffuser plate means extending from the first portion of said diffuser plate means adjacent the other side of said light source means, whereby each said diffuser plate means is principally illuminated at each said first portion thereof by direct light from said light source means spacedly adjacent thereto and is principally illuminated at each said second portion thereof by reflected light from said light source means, the illumination of said first and second portions of each said diffuser plate means being substantially equal.

12. The combination of claim 11, each said reflector means comprising reflector body means having a concavely curved reflecting surface facing at least one light source means and at least one diffuser plate means.

13. The combination of claim 12, each said reflector body means comprising a continuous curved structure.

14. The combination of claim 12, each said reflector body means comprising a segmented curved structure having parallel flat surfaces.

15. The combination of claim 12, each said reflector body means comprising a series of mutually angular parallel flat strips disposed in arched dispositions.

16. The combination of claim 11, wherein each said reflector means reflects plural mirror images of a light source means at a location spaced from the light source means to create the effect of another light source means at said location.

17. The combination of claim 11, wherein each said reflector means concentrates reflected light at a location spaced from the light source means to create illumination at said location simulating another light source means at said location.

18. The combination of claim 17, wherein said reflected light comprises mirror images of the light source.

19. The combination of claim 17, wherein said reflected light comprises diffuse images of the light source.

20. The combination of claim 11, wherein said diffuser plate means are rectilinear in shape and wherein approximately one half of each diffuser plate area is illuminated by direct light from a said light source means and wherein approximately the other half of each diffuser plate area is illuminated by reflected light from a said light source means.

21. The combination of claim 20, wherein said approximately one half of each diffuser plate area is illuminated by light emanating from a one half area of said light source means, and wherein said other half of each diffuser plate area is illuminated by light emanating from the other half area of said light source means.

22. The combination of claim 1, 4, 5, 11, 16, 17, 18, 19, 20, or 21 wherein each said light source means comprises fluorescent tube means.

23. The combination of claim 1, 4, 5, 11, 16, 17, 18, 19, 20, or 21 wherein each said light source means comprises incandescent bulb means.

24. Lighting apparatus, comprising diffuser plate means, reflector means having reflective surface means facing said diffuser plate means and being spaced therefrom to form one or more chambers between said diffuser plate means and said reflector means, a light source means disposed within said chamber means at a first light source location symmetrical with a second light source location where a second light source would normally be disposed in conventional lighting apparatus, said light source being disposed to directly illuminate a first approximate half-portion of said diffuser plate means, a second approximate half-portion of said diffuser plate means being illuminated by said light source means by light therefrom reflected to said second light source location, whereby said diffuser plate means is illuminated at both said approximate half-portions by said light source means and whereby it is made to appear that there is a said second light source means at said second light source location.

25. The combination of claim 24, wherein said reflective surface means is capable of reflecting plural images of said light source means to said second light source location.

26. The combination of claim 24 wherein said chamber means comprises plural chambers and wherein there are said first and second light source locations in each said chamber.

* * * * *